US007423591B2

(12) United States Patent
Fox

(10) Patent No.: US 7,423,591 B2
(45) Date of Patent: Sep. 9, 2008

(54) ANTENNA SYSTEM

(76) Inventor: Andrew John Fox, 9 Forest Gate, Pewsham, Chippenham, SN15 3RS (GB)

( * ) Notice: Subject to any disclaimer, the term of this patent is extended or adjusted under 35 U.S.C. 154(b) by 0 days.

(21) Appl. No.: 10/559,717

(22) PCT Filed: Jun. 2, 2004

(86) PCT No.: PCT/GB2004/002350

§ 371 (c)(1),
(2), (4) Date: May 18, 2006

(87) PCT Pub. No.: WO2004/109853

PCT Pub. Date: Dec. 16, 2004

(65) Prior Publication Data

US 2006/0232474 A1 Oct. 19, 2006

(30) Foreign Application Priority Data

Jun. 4, 2003 (GB) ..... 0312829.5

(51) Int. Cl.
*H01Q 1/38* (2006.01)

(52) U.S. Cl. ..... 343/700 MS; 343/702

(58) Field of Classification Search ..... None
See application file for complete search history.

(56) References Cited

U.S. PATENT DOCUMENTS 4,201,956 A * 5/1980 Kienberger et al. ..... 331/96
4,675,689 A * 6/1987 Haas et al. ..... 343/786
2001/0054978 A1* 12/2001 Adachi et al. ..... 343/700 MS
2003/0043075 A1 3/2003 Bit-Babik et al. ..... 343/700 MS
2003/0117325 A1* 6/2003 Jo et al. ..... 343/702

FOREIGN PATENT DOCUMENTS

| | | |
|---|---|---|
| EP | 0 587 247 | 3/1994 |
| EP | 0 801 436 | 10/1997 |
| GB | 2 355 855 | 5/2001 |
| GB | 2 360 134 | 9/2001 |
| JP | 09008539 | 1/1997 |
| WO | WO 00/14826 | 3/2000 |

OTHER PUBLICATIONS

International Search Report PCT/GB2004/002350; Aug. 20, 2004.
Kishk A A et al: "Conical Dielectric Resonator Antennas for Wide-Band Applications" IEEE Transactions on Antennas and Propagation, IEEE Inc. New York, US vol. 50, No. 4, Apr. 2002; pp. 469-474, XP001115186; ISSN: 0018-926X.
Kishk A A et al: "Broadband Stacked Dielectric Resonator Antennas" Electrics Letters, IEE Stevenage, GB, vol. 25, No. 18, Aug. 31, 1989, pp. 1232-1233, XP000071886; ISSN: 0013-5194.

(Continued)

*Primary Examiner*—Trinh V Dinh
(74) *Attorney, Agent, or Firm*—Cantor Colburn LLP

(57) ABSTRACT

An antenna system includes a dielectric resonator, provided with first and second electrical signal inputs. An electrical signal is fed through the first electrical signal input, and through the second electrical signal input with a significant phase difference, for example in the region of 180°. This has the advantage that the antenna bandwidth is increased, allowing the antenna system to be used in wideband applications.

22 Claims, 8 Drawing Sheets

OTHER PUBLICATIONS

Tam M T K et al: "Half volume dielectric resonator antenna designs"; Electronics Letters, IEE Stevenage, GB, vol. 33, No. 23, Nov. 6, 1997, pp. 1914-1916, XP006008177; ISSN: 0013-5194.

S.P. Kingsley and S.G. O'Keefe; "Beam steering and monopulse processing of probe-fed dielectric resonator antennas"; IEE Proc.-Radar, Sonar Navig., vol. 146, No. 3, Jun. 1999, pp. 121-125.

Rajesh K. Mongia, et al., "Dielectric Resonator Antennas—A Review and General Design Relations for Resonant Frequency an dbandwidth"; International Journal of Microwave and Millimeter-wave Computer-Aided Engineering; vol. 4, No. 3; pp. 230-247 (1994).

Gregory P. Junker, et al.; "Multiport Network Description and Radiation Characteristics of Coupled Dielectric Resonator Antennas"; IEEE Transations on Antennas and Propagation, vol. 46, No. 3, Mar. 1998.

* cited by examiner

ANTENNA SYSTEM

TECHNICAL FIELD OF THE INVENTION

This invention relates to an antenna system, and in particular to an antenna system that allows a dielectric resonator antenna to be used for relatively wideband microwave or radio frequency signal transmission and reception.

DESCRIPTION OF THE RELATED ART

Dielectric resonator antennas are known, in which a suitably sized and shaped piece of low loss dielectric material is mounted on a ground plane. In order to transmit a signal, a specific mode of operation is excited by feeding an electrical signal into the dielectric material.

Dielectric resonator antennas are to be contrasted with patch antennas, which are commonly used in portable transceiver devices such as mobile phones, in which a patch of a conductive material is used as an antenna. Although dielectric resonator systems sometimes appear superficially similar to patch antenna systems, they are actually used in completely different ways. In particular, they are typically operated in different excitation modes, which radiate by different mechanisms, and so it follows that the arrangements for feeding the required electrical signals into the antenna are also completely different.

It is generally desirable to have a very small antenna but with a wide bandwidth. However, this is not generally possible with dielectric resonator antennas (DRAs). This is due to the fact that a wide bandwidth is associated with a low dielectric constant DRA. Since the size of the DRA is inversely related to the square root of the dielectric constant, a low dielectric constant will result in a wide bandwidth antenna but will cause the DRA to be larger in size.

EP-A-0801436 describes the use of dielectric resonator antennas, and discloses one proposed solution to a problem with dielectric resonator antennas, namely their relatively narrow operational bandwidths.

BRIEF SUMMARY OF THE INVENTION

According to the present invention, there is provided an antenna system which allows a dielectric resonator antenna to be used to provide a relatively wide transmission bandwidth.

In particular, according to a first embodiment, there is provided an antenna system, in which a dielectric resonator is provided with first and second electrical signal inputs, and an electrical signal is fed through the first electrical signal input, and through the second electrical signal input with a significant phase difference.

This has the advantage that the antenna bandwidth is increased, allowing the antenna system to be used in wideband applications.

In particular, the bandwidth enhancement is achieved while maintaining relatively high field containment, that is, without making the performance of the antenna more sensitive to the presence of nearby metal objects.

According to a second embodiment, an input signal is magnetically coupled with the dielectric resonator. Again, the input signal is magnetically coupled with the dielectric resonator at two points, with a significant phase difference.

This again has the advantage that the antenna bandwidth is increased, allowing the antenna system to be used in wideband applications.

In preferred embodiments of the invention, the input signal is electrically or magnetically coupled with a higher order mode of the dielectric resonator, and a mirror is placed at the end of the dielectric resonator, creating an image of the dielectric material required for the higher order mode.

BRIEF DESCRIPTION OF THE DRAWINGS

For a better understanding of the present invention, and to show how it may be put into effect, reference will now be made, by way of example, to the accompanying drawings, in which:—

DETAILED DESCRIPTION OF THE INVENTION

Figure 1:
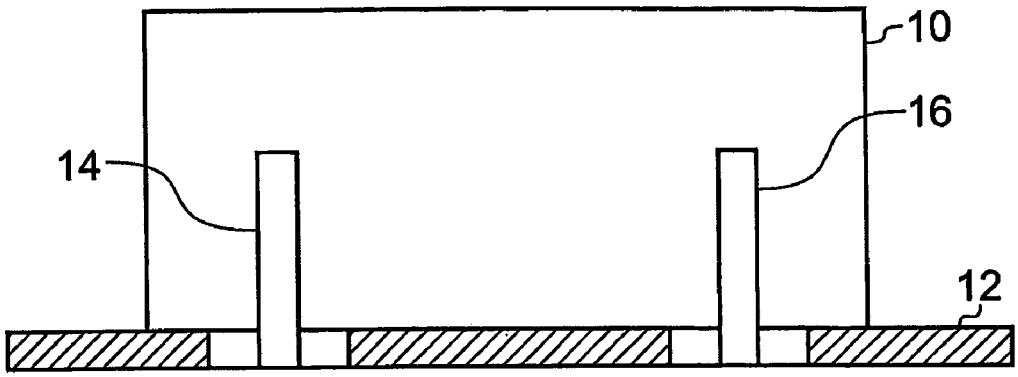
FIG. 1 is a schematic illustration of an antenna system in accordance with the present invention.

FIG. 1 is a schematic side view of an antenna system in accordance with the present invention. A "puck" of dielectric material 10 is sized and shaped to resonate, and therefore act as an antenna, in the desired operational frequency range, and is mounted on a ground plane 12.

The operational bandwidth of the antenna is determined by, amongst other things, the dielectric constant of the dielectric material, and the radius-to-height ratio of the puck (if the puck has a circular cross-section), and these parameters can be chosen in a conventional way to achieve the desired bandwidth in the system shown herein. In this illustrative preferred embodiment of the invention, the dielectric material is in the form of a cuboid, having length:height:width ratios of 2:1:0.8.

One conventional way of feeding an electrical signal to a dielectric resonator is by way of a monopole coaxial feed line. However, in the embodiment of the present invention shown in FIG. 1, there are two such monopole coaxial feed lines 14, 16, or probes, connected to the dielectric resonator antenna 10 such that they are coupled with its fundamental leaky hybrid electric mode (HEM11d). The position of each of the probes can be determined in a way which generally corresponds to the conventional way of determining feed positions, namely locating and dimensioning the probes such that a desired impedance is achieved, based upon the mode which is to be excited.

An input electrical signal is fed to the two feed lines 14, 16, such that there is a substantial phase difference between the signals fed to the two lines. The phase difference is preferably close to 180°, or to an odd multiple of 180° (for example, 540°, 900°, etc). However, the phase difference should preferably not be exactly equal to 180°, or to an odd multiple of 180°. For example, the phase difference might advantageously be in the range of 160°-200° (or 520°-560°, or 880°-920°, etc); or in the range of 150°-210° (or 510°-570°, or 870°-930°, etc); or in the range of 140°-220° (or 500°-580°, or 860°-940°, etc); or in the range of 140°-160° or 200°-220° (or 500°-520°, 560°-580°, 860°-880° or 920°-940°, etc).

This has the effect that the two feed lines cause resonances, which interact with each other in such a way that the S11 response of the antenna has two nulls, with the frequencies of the two nulls being slightly offset from each other such that the antenna has a broadened operational bandwidth. For example, defining the operational bandwidth as being the range of frequencies at which the return loss is better than 10 dB, if there is a 150° phase difference between the signals on the two feed lines, the operational bandwidth may be doubled compared with a conventional dielectric resonator antenna having a single feed line.

Figure 2A:
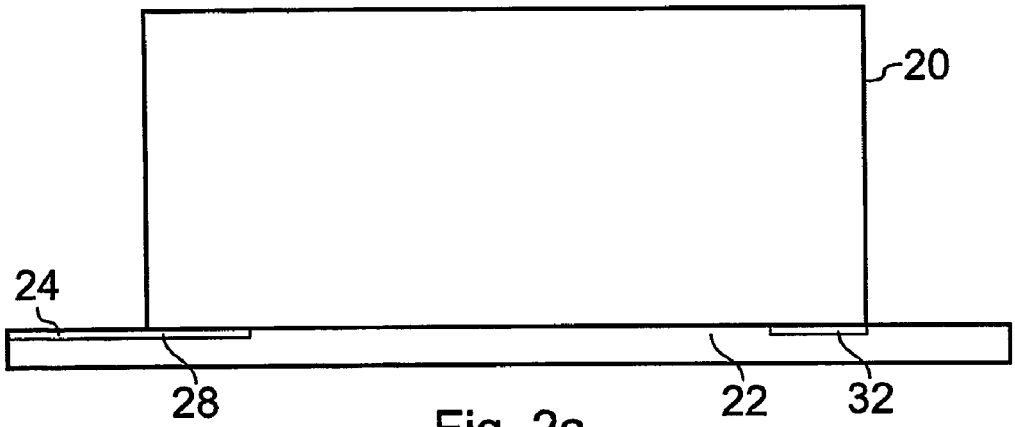
FIG. 2 is a schematic illustration of a second antenna system in accordance with the present invention.
Figure 2B:
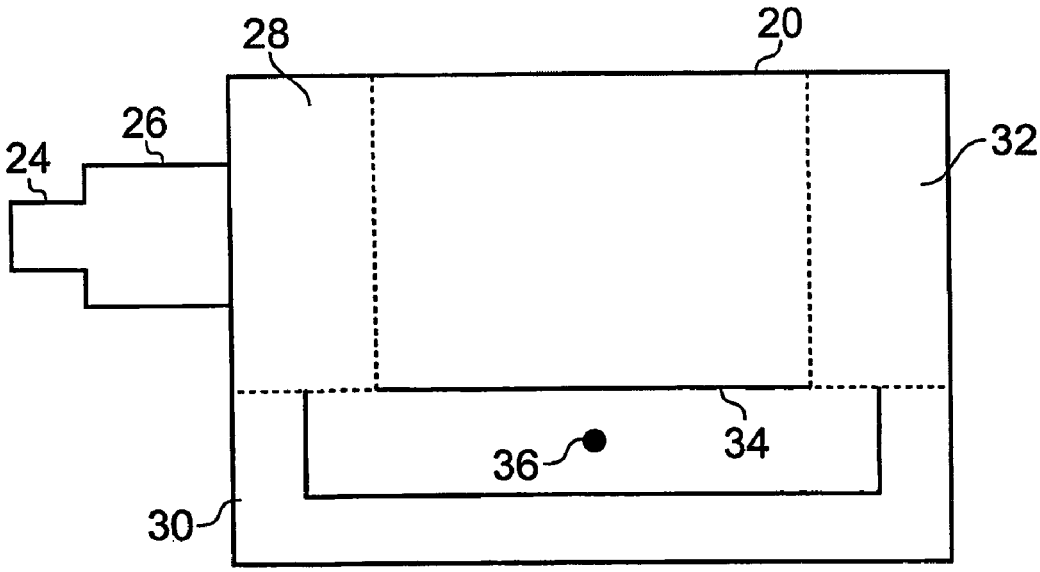

FIG. 2*a* is a side view and FIG. 2*b* is a plan view of an alternative antenna system in accordance with the present invention, in which the electrical signal is fed to the antenna through pads.

Specifically, a dielectric resonator antenna 20 is mounted on a substrate 22. As in the FIG. 1 embodiment, the dielectric material 20 is in the form of a cuboid, which is sized and shaped to resonate, and therefore act as an antenna; in the desired operational frequency range, preferably having length:height:width ratios of 2:1:0.8.

In this case, the electrical signal is supplied along an input copper microstrip line 24, which has an impedance matching section 26, the form of the microstrip line 24 and the impedance matching section 26 being generally conventional. The electrical signal is supplied to the dielectric material 20 through a pad 28, which is located below the dielectric material. Again, the form of the pad 28 is generally conventional, although it will be noted that the pad 28 extends across the whole width of the dielectric material 20. In this illustrated embodiment of the invention, the pad 28 extends along the length of the dielectric material for a distance which is equal to 0.4 times the height of the dielectric material.

In this case, however, a further microstrip line 30 leads from the pad 28 to a second pad 32, which is located below the dielectric material, but extending across the whole width of the dielectric material, at the opposite end thereof. The electrical signal is therefore also applied to the dielectric resonator antenna 20 at this opposite end.

The dimensions of the dielectric material 20, and the positions of the pads 28, 32, are chosen such that the applied electrical signal excites the fundamental leaky hybrid electric mode (HEM11d) at the desired frequency.

Again, in this illustrated embodiment of the invention, the pad 32 extends along the length of the dielectric material for a distance which is equal to 0.4 times the height of the dielectric material.

As in the embodiment of FIG. 1, the input electrical signal is fed to the two pads 28, 32 such that there is a substantial phase difference between the signals fed to the two lines.

In preferred embodiments of the invention, the phase difference arises as a result of the additional path length which the signals must travel along the further microstrip line 30. For example, a microstrip line 30 having a length of about 20 mm may produce a phase difference of about 180° in the case of signals at a frequency of 5 GHZ, but the phase difference will be correspondingly smaller (or larger) for signals at lower (or higher) frequencies. However, any phase shift element may be inserted into the line 30, if desired.

Again, the phase difference is preferably close to 180°, or to an odd multiple of 180° (for example, 540°, 900°, etc). However, the phase difference should not be exactly equal to 180°, or to an odd multiple of 180°. For example, the phase difference might advantageously be in the range of 160°-200° (or 520°-560°, or 880°-920°, etc); or in the range of 150°-210° (or 510°-570°, or 870°-930°, etc); or in the range of 140°-220° (or 500°-580°, or 860°-940°, etc); or in the range of 140°-160° or 200°-220° (or 500°-520°, 560°-580°, 860°-880°, or 920°-940°, etc).

Moreover, the presence of the microstrip line 30, running parallel to the edge 34 of the dielectric resonator antenna 20, has an effect on the resonances excited within the dielectric material. Therefore, a tuning screw 36 is provided in the area between the dielectric resonator antenna 20 and the microstrip line 30, half way along the length of the antenna 20. The tuning screw 36 acts as a choke in the magnetic field between the dielectric resonator antenna 20 and the microstrip line 30, and adjustment of the amount by which the screw 36 protrudes from the substrate 22 into the magnetic field makes it possible to adjust the degree of coupling between the antenna 20 and the microstrip line 30. This adjustment can take place for example after manufacture, and the frequency response of the antenna system can then be trimmed to give the required properties.

Figure 3A:
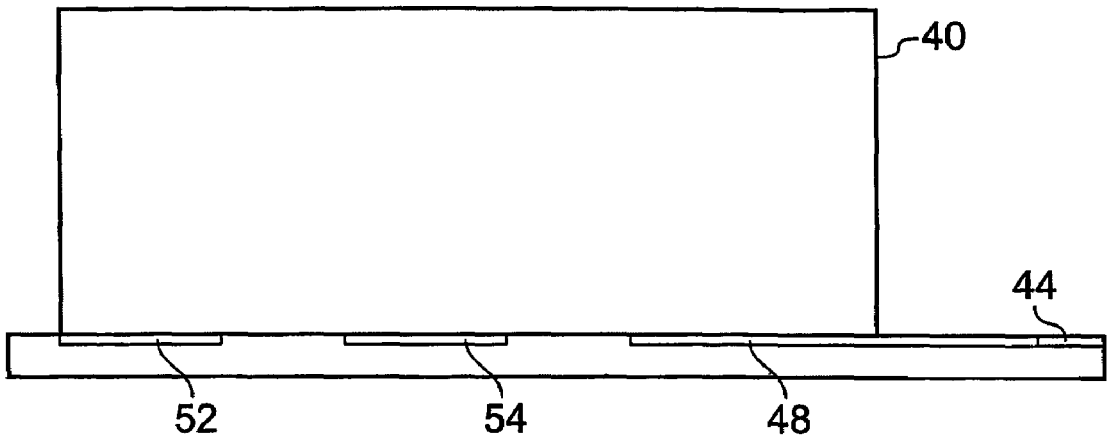
FIG. 3 is a schematic illustration of a third antenna system in accordance with the present invention.
Figure 3B:
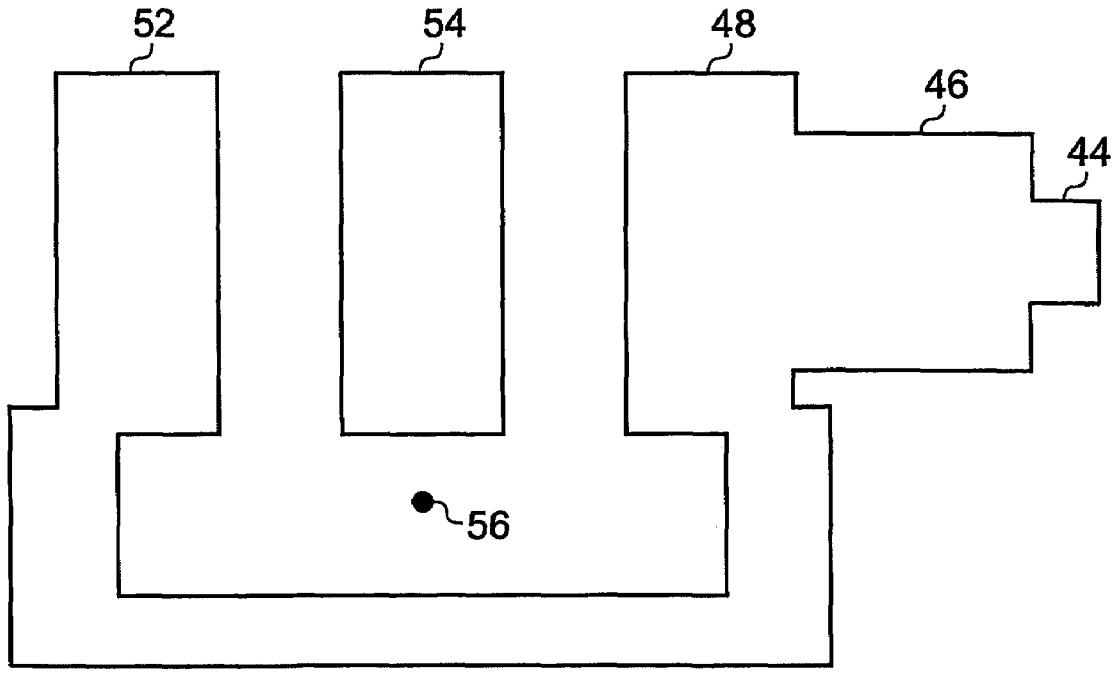

FIG. 3 shows a further alternative antenna system in accordance with the present invention, in which the electrical signal is fed to the antenna through pads. Specifically, FIG. 3*a* is a side view and FIG. 3*b* is a plan view of an antenna system from which the dielectric resonator itself has been removed for clarity.

Specifically, a dielectric resonator antenna 40 is mounted on a substrate 42. As before, the dielectric material 40 is in the form of a cuboid, having length:height:width ratios of 2:1:0.8, which is sized and shaped to resonate, and therefore act as an antenna, in the desired operational frequency range. In this case, the electrical signal is supplied along an input copper microstrip line 44, which has an impedance matching section 46, the form of the microstrip line 44 and the impedance matching section 46 being generally conventional. The electrical signal is supplied to the dielectric material 40 through a pad 48, which is located below the dielectric material. Again, the form of the pad 48 is generally conventional, although it will be noted that the pad 28 extends across the whole width of the dielectric material 20. Again, in this illustrated embodiment of the invention, the pad 48 extends along the length of the dielectric material for a distance which is equal to 0.4 times the height of the dielectric material.

A further microstrip line 50 leads from the pad 48 to a second pad 52, which is located below the dielectric material, and extends across its whole width, at the opposite end thereof. Again, in this illustrated embodiment of the invention, the pad 52 extends along the length of the dielectric material for a distance which is equal to 0.4 times the height of the dielectric material.

The electrical signal is therefore also applied to the dielectric resonator antenna 40 at this opposite end. Again, a tuning screw 56 is provided between the dielectric resonator antenna 40 and the microstrip line 50.

As in the embodiment of FIG. 1, the input electrical signal is fed to the two pads 48, 52 such that there is a substantial phase difference between the signals fed to the two lines.

Again, the phase difference is preferably close to 180°, or to an odd multiple of 180° (for example, 540°, 900°, etc). However, the phase difference should not be exactly equal to 180°, or to an odd multiple of 180°. For example, the phase difference might advantageously be in the range of 160°-200° (or 520°-560°, or 880°-920°, etc); or in the range of 150°-210° (or 510°-570°, or 870°-930°, etc); or in the range of 140°-220° (or 500°-580°, or 860°-940°, etc); or in the range of 140°-160° or 200°-220° (or 500°-520°, 560°-580°, 860°-880°, or 920°-940°, etc).

In this case, however, there is a third pad 54, which is located centrally under the dielectric material 40. The primary purpose of the third pad 54 is to provide a stable way of mounting the dielectric material 40 to the substrate 22, in particular, allowing the ceramic to be flow soldered onto the substrate. However, its presence will also have an effect on the coupling of the magnetic field generated by the dielectric material 40. It may therefore be necessary either alter the degree of coupling by means of the tuning screw 56, or by reducing the distances by which the pads 48, 52 extend from their respective ends along the dielectric material 40.

Figure 4:
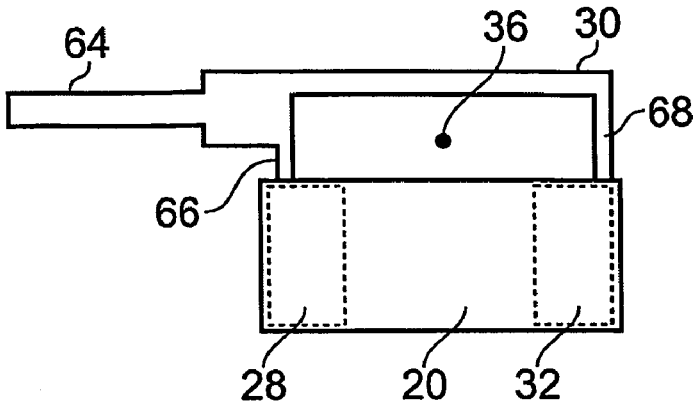
FIG. 4 is a schematic illustration of a fourth antenna system in accordance with the present invention.

FIG. 4 is a plan view of an antenna system in accordance with another embodiment of the invention. The antenna system is similar to that shown in FIG. 2, and reference numerals, which are common to the two Figures, refer to corresponding features. The difference is that, in the embodiment of FIG. 4, the input feed line 64 is connected to an input line 66, which feeds into the side of the pad 28, rather than into the end. At the opposite end of the dielectric material 20, the input feed line 64 is connected through the microstrip line 30 to an input line 68, which again feeds into the side of the pad 32.

The embodiments of the invention described so far have all involved excitation of the fundamental HEM mode of the dielectric material. However, it is also possible to excite a higher order mode, by appropriate choice of dimensions of the dielectric material, in conjunction with the operating frequency and the positions of the pads which feed the signal into the dielectric material.

Figure 5:
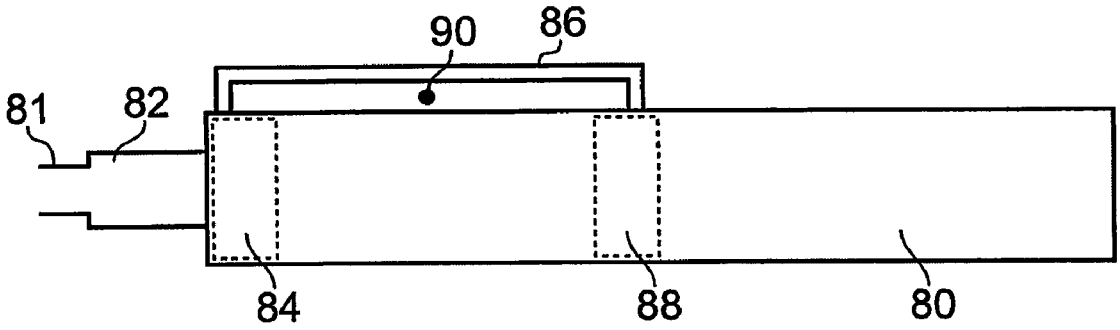
FIG. 5 is a schematic illustration of a fifth antenna system in accordance with the present invention.

FIG. 5 is a plan view illustrating an antenna system in accordance with another embodiment of the invention, in which a higher order mode is excited.

A dielectric resonator antenna 80 is mounted on a substrate (not shown). The dielectric material 80 is in the form of a cuboid, which is sized and shaped to resonate, and therefore act as an antenna, in the desired operational frequency range, preferably having length:height:width ratios of 6:1:0.8. Thus, compared with the previous illustrated embodiments, the length of the dielectric material is three times greater. The input electrical signal is applied such that it excites a higher order leaky hybrid electric mode, namely the HEM13d mode, of the dielectric material at the desired frequency.

The electrical signal is supplied along an input copper microstrip line 81, which has an impedance matching section 82, the form of the microstrip line 81 and the impedance matching section 82 being generally conventional. At one end, the electrical signal is supplied to the dielectric material 80 through a pad 84, which is located below the dielectric material. Again, the pad 84 extends across the whole width of the dielectric material 80, and extends along the length of the dielectric material for a distance which is equal to 0.4 times the height of the dielectric material.

A further microstrip line 86 leads from the pad 84 to a second pad 88, which is located below the dielectric material 80, but extending across the whole width of the dielectric material, approximately one third of the distance along the dielectric material from the first end. The electrical signal is therefore also applied to the dielectric resonator antenna 80 at this point, and this causes the HEM13d mode to be excited.

Again, in this illustrated embodiment of the invention, the pad 88 extends along the length of the dielectric material for a distance which is equal to 0.4 times the height of the dielectric material.

As in previous embodiments, the input electrical signal is fed to the two pads 84, 88, such that there is a substantial phase difference between the signals fed to the two lines.

In preferred embodiments of the invention, the phase difference arises as a result of the additional path length which the signals must travel along the further microstrip line 86. However, another phase shift element may be inserted into the line 86, if desired.

Again, the phase difference is preferably close to 180°, or to an odd multiple of 180° (for example, 540°, 900°, etc). However, the phase difference should not be exactly equal to 180°, or to an odd multiple of 180°. For example, the phase difference might advantageously be in the range of 160°-200° (or 520°-560°, or 880°-920°, etc); or in the range of 150°-210° (or 510°-570°, or 870°-930°, etc); or in the range of 140°-220° (or 500°-580°, or 860°-940°, etc); or in the range of 140°-160° or 200°-220° (or 500°-520°, 560°-580°, 860°-880°, or 920°-940°, etc).

Moreover, a tuning screw 90 is provided in the area between the dielectric resonator antenna 80 and the microstrip line 86, half way along the length of the microstrip line 86.

The tuning screw 90 acts as a choke in the magnetic field between the dielectric resonator antenna 80 and the microstrip line 86, and adjustment of the amount by which the screw 90 protrudes from the substrate into the magnetic field makes it possible to adjust the degree of coupling between the antenna 80 and the microstrip line 86.

Figure 6:
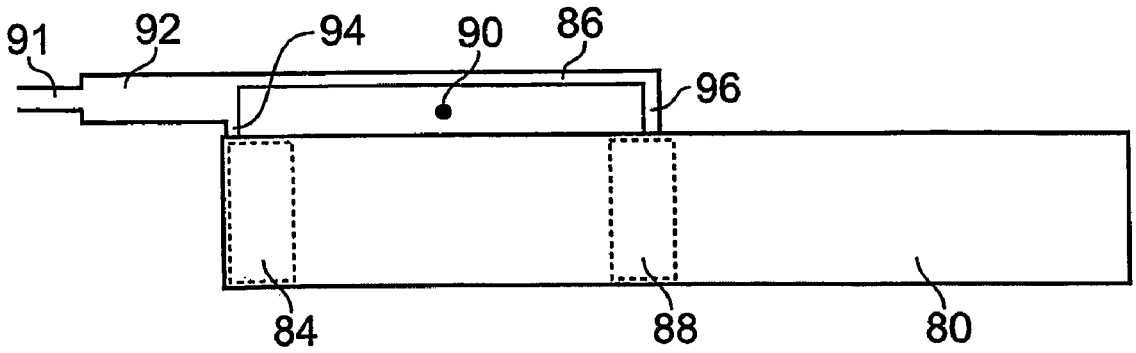
FIG. 6 is a schematic illustration of a sixth antenna system in accordance with the present invention.

FIG. 6 is a plan view of an antenna system in accordance with another embodiment of the invention. The antenna system is similar to that shown in FIG. 5, and reference numerals, which are common to the two Figures, refer to corresponding features. The difference is that, in the embodiment of FIG. 6, the input feed line 91 is connected through the impedance matching section 92 to an input line 94, which feeds into the side of the pad 84, rather than into the end. Further along the dielectric material 80, the input feed line 81 is connected through the microstrip line 86 to an input line 96, which again feeds into the side of the pad 88.

Again, therefore, the applied electrical signal excites the HEM13d mode at the desired frequency.

It will be appreciated that, by appropriate placement of feed pads, any desired HEM mode can be excited.

The bandwidth enhancement of higher order mode dielectric resonator antennas, such as a dielectric resonator antenna operating in its HEM13d mode, is a highly advantageous application of this invention. A dielectric resonator antenna operating in this mode effectively forms a solid dielectric array. However, higher order modes suffer from a very narrow bandwidth. Conventionally, therefore, in order to make this dielectric array useful, it is necessary to use a very low dielectric constant material. However, by applying the techniques described herein, the bandwidth can be extended to cover a useable range of frequencies. For example, the antenna can be designed to have a bandwidth which covers the 4.9 GHz to 5 GHz band, or the 5.03 to 5.091 GHz band, or the 5.15 GHz to 5.25 GHz band, or the 5.25 GHz to 5.35 GHz band, or the 5.725 GHz to 5.875 MHz band, or any comparable frequency band.

In a solid dielectric resonator antenna array, the form of bandwidth enhancement disclosed herein widens the 10 dB return loss bandwidth by over a factor 2 and enables full coverage of one of these bands without the need for exact tuning. Such a property leads to a low cost and very compact array.

Using the HEM15d mode instead of the HEM13d mode, even more gain can be obtained at the expense of bandwidth. However, using the bandwidth enhancement technique described herein would make this mode useable for this application.

In the embodiment of FIG. 3, described above, an additional pad 54 was provided underneath the dielectric material 40, as well as the two pads 48, 52 to which the electrical signal is applied. The primary function of the additional pad 54 is to give structural support to the dielectric material 40. In a similar way, in the embodiments of FIG. 5 or 6, as well as the two pads 84, 88 to which the electrical signal is applied, one or more additional pads could be positioned underneath the dielectric material 80. Such additional pads could be located between the pads 84, 88, or, most advantageously, towards the free end of the dielectric material 80 to give structural support to the dielectric material.

The invention has been described above with reference to a situation in which an electrical signal is supplied to the two probes 14, 16, or to the two pads 28, 32, or 48, 52, or 84, 88, with a phase difference which causes the frequency response of the antenna to have two nulls in its return loss characteristic, spaced such that the operating bandwidth of the antenna is effectively broadened.

In particular, in preferred embodiments, the bandwidth of a particular antenna is doubled, whilst keeping the size and dielectric constant of the particular antenna the same. One result of this, for example, is that, given a particular bandwidth requirement, the size of the antenna can be reduced (compared with a conventional device) by using a material with a higher dielectric constant, while still meeting the bandwidth requirements. This has an added advantage of greater near field containment around the antenna caused by the higher dielectric constant. This technology is therefore particularly useful in mobile devices and duplexer-less systems where antenna to antenna isolation is most desirable.

As an alternative to the situation described above, in which an electrical signal is supplied to the two probes, or the two pads, with a phase difference which causes the frequency response of the antenna to have two nulls in its return loss characteristic, spaced such that the operating bandwidth of the antenna is effectively broadened, it is possible to supply an electrical signal to the two probes 14, 16, or to the two pads 28, 32, or 48, 52, or 84, 88, with a phase difference which causes the frequency response of the antenna to have two nulls in its return loss characteristic, with the two nulls being spaced sufficiently far apart that the antenna can effectively be considered as a dual band antenna.

There have therefore been described various devices which provide an improved bandwidth, by electrically coupling to the field patterns within the dielectric resonator. However, it is also possible to achieve the same effect by magnetically coupling to the field patterns within the dielectric resonator.

Figure 7B:
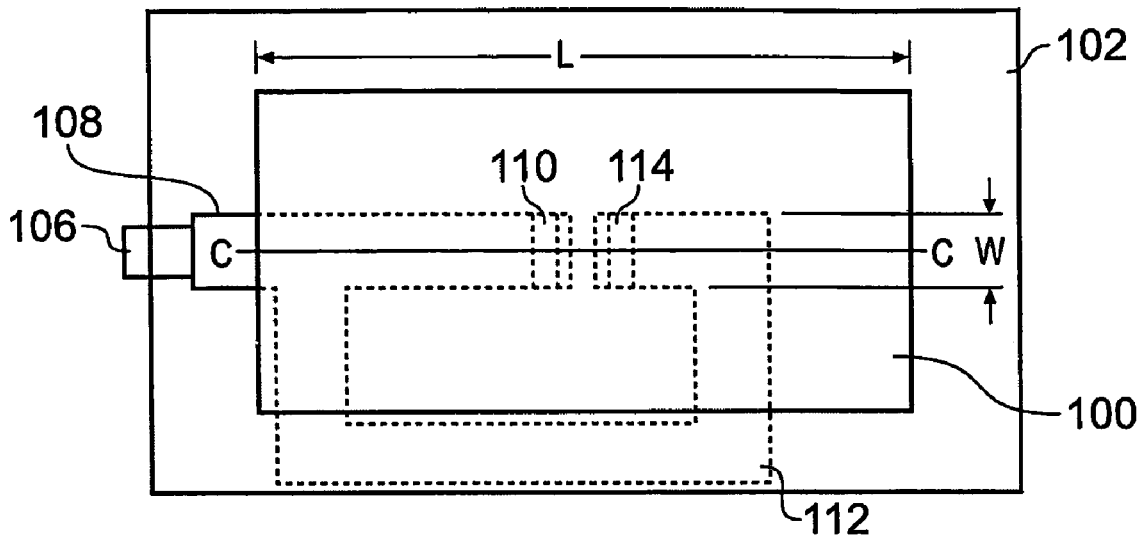
FIG. 7 is a schematic illustration of a seventh antenna system in accordance with the present invention.
Figure 7A:
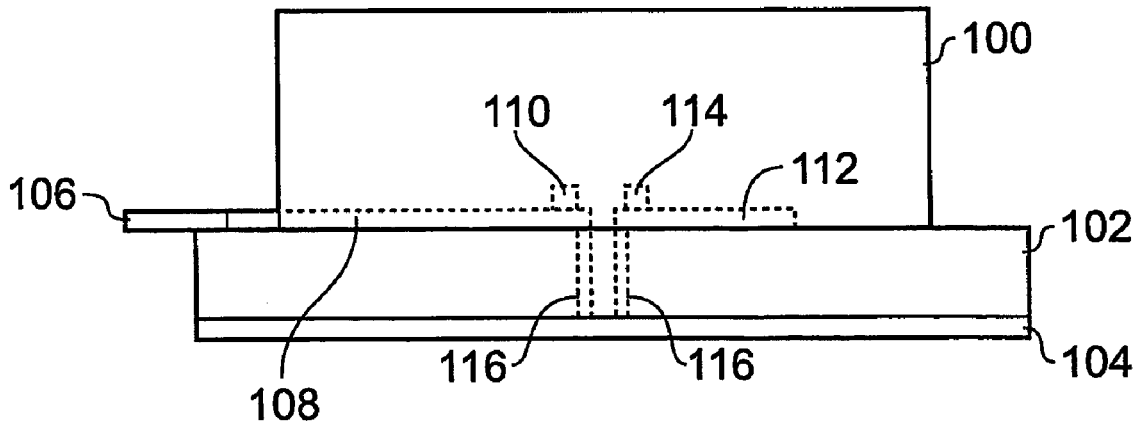

FIG. 7 therefore shows a further alternative antenna structure in accordance with the invention. Specifically, FIG. 7*a* is a side view and FIG. 7*b* is a plan view.

A block of dielectric material 100 is mounted on a substrate 102, which is in turn mounted on a ground plane 104. The block of dielectric material 100 is sized and shaped to resonate, and therefore act as an antenna, in the desired operational frequency range. Input electrical signals are fed into the device by means of a connector 106, which is in turn connected to a feed line 108 which is mounted on the substrate 102. As is known, the input electrical signals on the feed line 108 generate a magnetic field in the region surrounding the feed line 108, and this can be coupled into the dielectric material 100 by extending the feed line 108 under the dielectric material 100 and providing a slot 110 in the dielectric material 100.

In accordance with the present invention, an advantageous bandwidth enhancement can be achieved by coupling the input signal into the dielectric material 100 at two different points, with a significant phase difference therebetween.

Thus, the feed line 108 is provided with a branch 112 and the input signals can be coupled into the dielectric material 100 by extending the feed line branch 112 under the dielectric material 100 and providing a second slot 114 in the dielectric material 100.

In preferred embodiments of the invention, the phase difference arises as a result of the additional path length which the signals must travel along the branch feed line 112. However, another phase shift element may be inserted into the line 112, if desired.

Again, the phase difference is preferably close to 180°, or to an odd multiple of 180° (for example, 540°, 900°, etc). However, the phase difference should not be exactly equal to 180°, or to an odd multiple of 180°. For example, the phase difference might advantageously be in the range of 160°-200° (or 520°-560°, or 880°-920°, etc); or in the range of 150°-210° (or 510°-570°, or 870°-930°, etc); or in the range of 140°-220° (or 500°-580°, or 860°-940°, etc); or in the range of 140°-160° or 200°-220° (or 500°-520°, 560°-580°, 860°-880°, or 920°-940°, etc).

The widths, w, of the slots 110, 114 can be chosen to be any convenient value to give the desired impedance value for the antenna, for example 50Ω.

The feed line 108 and branch feed line 112 need to be terminated, or shorted, at the respective slot 110, 114. This can be achieved by connecting the feed line 108 and branch feed line 112 to the ground plane 104, for example through a series of vias 116 extending through the substrate 102.

In the fundamental HEM11d mode, the magnetic field is at its greatest at the centre of the dielectric material 100. Therefore, in order to improve the magnetic coupling, it is advantageous for the two slots 110, 114 to be close together, near the mid-point of the length L of the dielectric material. However, the slots can in principle be at any points along the centre line C-C of the dielectric material.

Further, when a higher order mode is being used, the magnetic field pattern will have peaks at other locations in the dielectric material 100, and the two slots can be provided at the relevant points, to ensure suitable coupling into the magnetic field.

It will also be appreciated that, although FIG. 7 shows the feed line 108 to the slot 110 entering the dielectric material 100 at one end, and a branch line 112 to the slot 114, other arrangements are also possible. For example, a feed line could enter the dielectric material from the side, while other forms of the branch line are also possible.

Figure 8B:
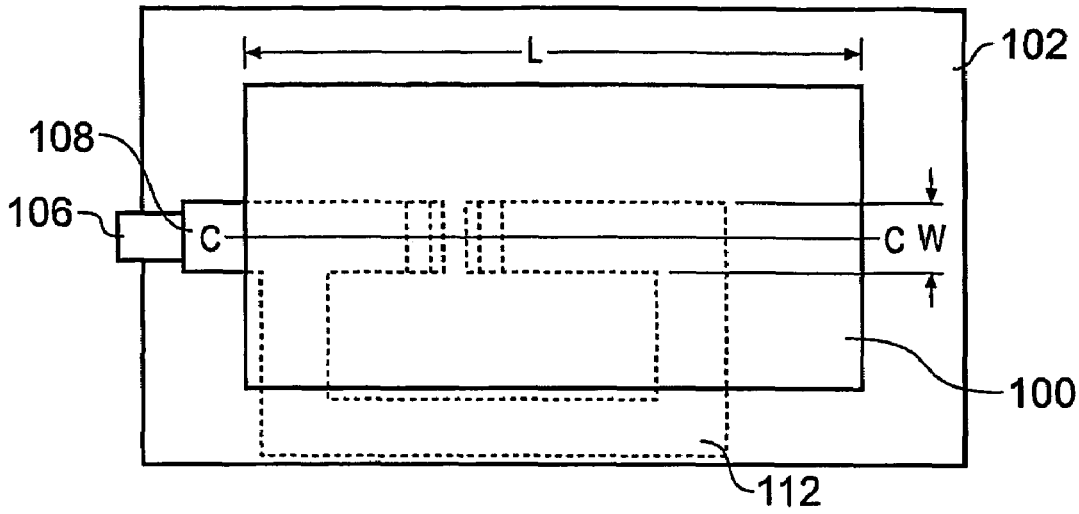
FIG. 8 is a schematic illustration of an eighth antenna system in accordance with the present invention.
Figure 8A:
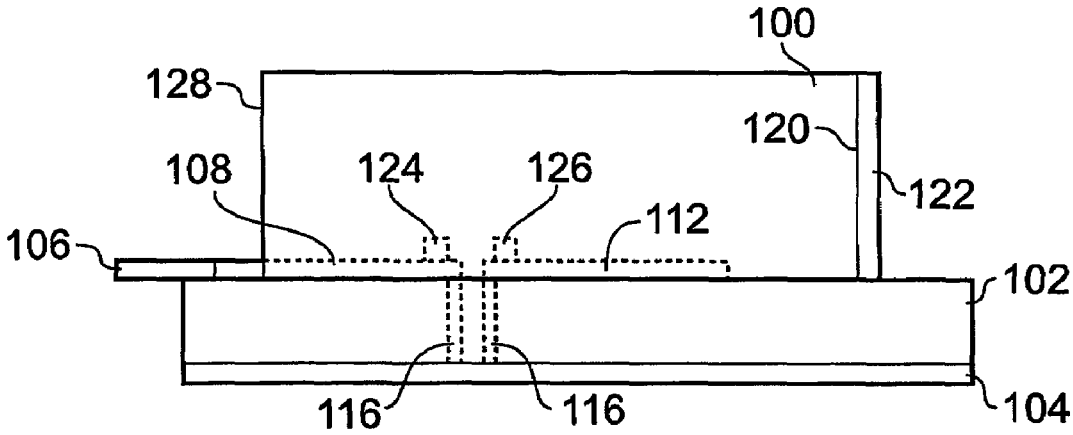

FIG. 8 shows a further alternative antenna structure in accordance with the invention. Specifically, FIG. 8*a* is a side view and FIG. 8*b* is a plan view. In this case, it will be noted that the structure of FIG. 8 is very similar to that of FIG. 7, with corresponding reference numerals indicating the same features. The description of those features will therefore not be repeated. In this case, however, one end face 120 of the dielectric material 100 is coated with metal 122. This acts as a perfect electric conductor, and hence acts as a mirror for the electromagnetic field. This has the effect that the electromagnetic field pattern within the dielectric material 100 is the same as it would have been, if the dielectric material 100 had been twice as long. The use of the mirror 122 therefore allows the size of the dielectric material 100 to be halved.

This arrangement is most useful when the dielectric material 100 is to be used in a higher order mode. In the case of the HEM13d mode, for example, the maxima in the magnetic field distribution occur at the centre of the block of dielectric material, and at points ⅙ of the length of the block from each end of the block. Therefore, when using a perfect electric conductor as a mirror on one end face of the block of dielectric material, the maxima in the magnetic field distribution occur at the end face which has the perfect electric conductor on it, and at a point ⅓ of the length of the block from the opposite end of the block.

FIGS. 8*a* and 8*b* show an embodiment of the invention using magnetic coupling into the HEM13d mode.

Therefore slots 124, 126 are provided at a point in the dielectric material which is a distance L/3 from the end face 128 which is opposite the end face 120 on which the perfect electric conductor is provided. These slots are then provided at a point close to a maximum in the magnetic field distribution.

As before, the feed line 108 and branch feed line 112 are shorted to the ground plane 104 through a series of vias 116 extending through the substrate 102.

The input electrical signal can then be supplied at an appropriate frequency, taking into account the resonant frequency of the dielectric material 100 and the mode which is to be excited. It will be appreciated that any suitable mode may be used.

It should also be appreciated that, while FIG. 8 shows the use of a mirror on one end face of the dielectric material when the input signal is to be magnetically coupled into the dielectric material, such use of a mirror on one end face of the dielectric material is equally possible when the input signal is to be electrically coupled into the dielectric material, as illustrated in any of FIGS. 1-6.

Figure 9:
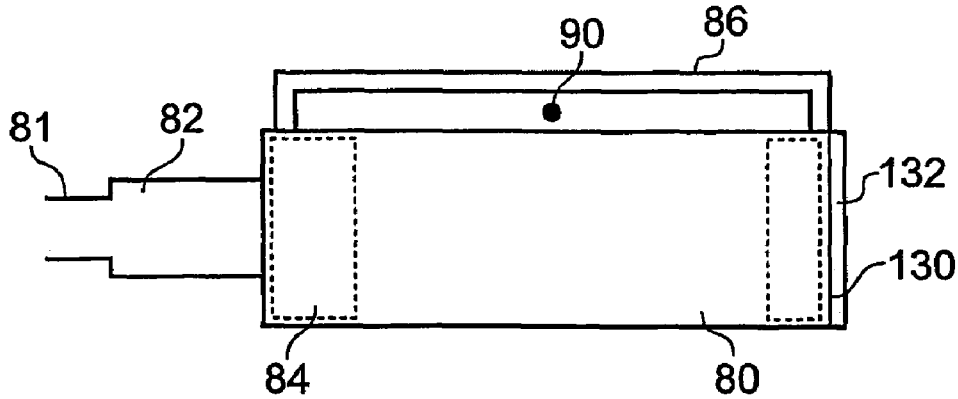
FIG. 9 is a schematic illustration of a ninth antenna system in accordance with the present invention.

Thus, FIG. 9 shows a plan view of a still further alternative antenna structure in accordance with the invention. In this case, it will be noted that the structure of FIG. 9 is very similar to that of FIG. 5, with corresponding reference numerals indicating the same features. The description of those features will therefore not be repeated. In this case, however, the right-hand half of the dielectric material 80 has been removed, and the newly formed end face 130 of the dielectric material 80 is coated with metal 132. This acts as a perfect electric conductor, and hence acts as a mirror for the electromagnetic field. This has the effect that the electromagnetic field pattern within the remaining dielectric material 80 is the same as it would have been, if the dielectric material 80 had been twice as long. The use of the mirror 132 therefore allows the size of the dielectric material 100 to be halved.

As mentioned above, the techniques described herein can be used to enhance the operating bandwidth of dielectric resonator antennas. Another situation, where such bandwidth enhancement is valuable, arises in the case of vertical solid dielectric resonator antennas.

A vertical solid dielectric resonator antenna can be designed by considering a block of dielectric material, which is of a suitable size and shape to operate in its fundamental resonant mode at a particular operating frequency. Another block, having the same length and width (or radius, in the case of a circular block of dielectric material) as the first block, but having a height which is an integer multiple of the height of the first block, would then resonate at that same or a similar frequency in a different resonant mode. For example, if the first block resonates in the HEM11δ mode, and if the height is three times the height of the first block, the material would resonate in its HEM11 (2+δ) mode. However, the invention is applicable to antennas having any shape which supports the desired mode of operation, which may be any HEM11 (x+δ) mode, for any value of x greater than zero.

Typically, vertical solid dielectric resonator antennas have a relatively narrow bandwidth. The bandwidth enhancement techniques described above, namely supplying an electrical signal to two points in the dielectric resonator antenna with a phase difference therebetween, such that the two points each couple to a desired resonant mode of the device, can therefore be used in order to increase the bandwidth to the point where such devices become usable in practice.

It has been found that, in order to increase the available bandwidth enhancement, a flared structure of the dielectric resonator is preferable.

Figure 10A:
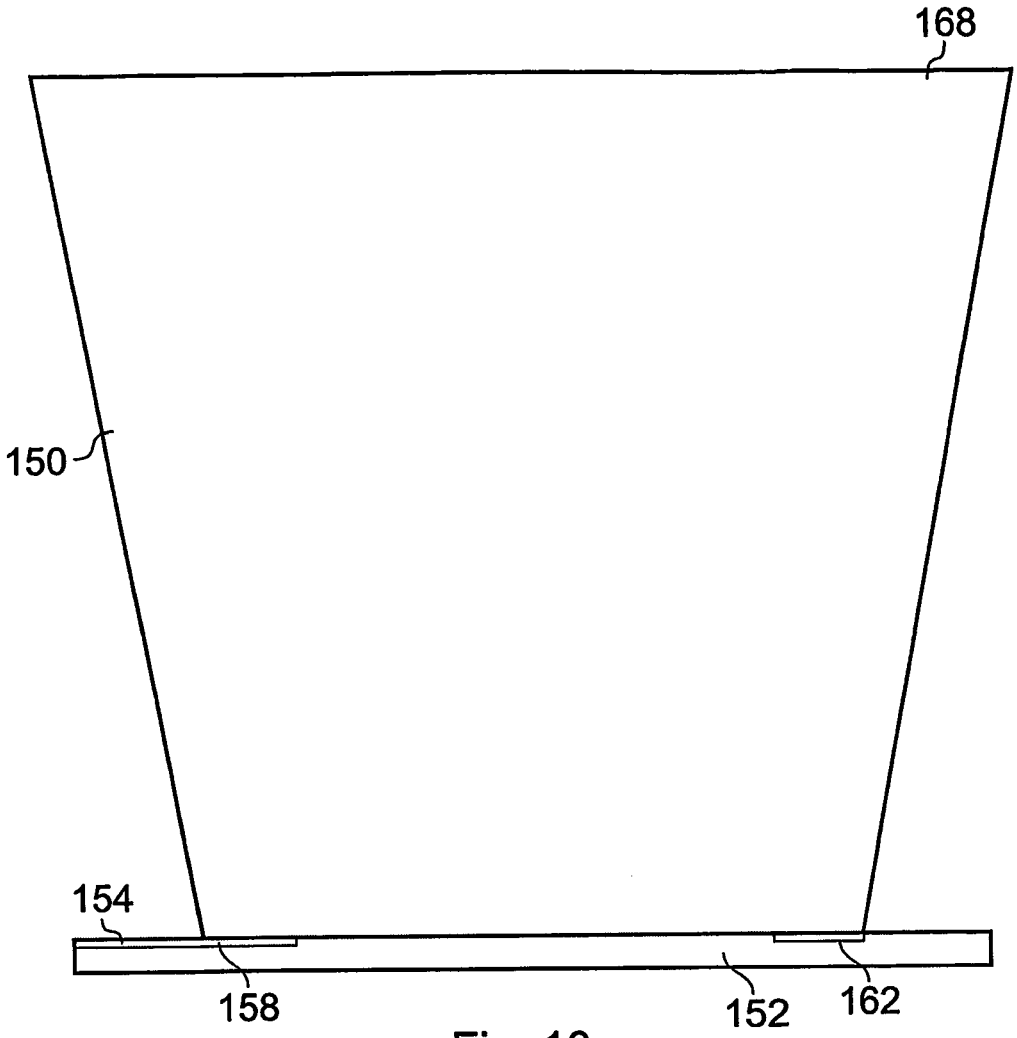
FIG. 10 is a schematic illustration of a tenth antenna system in accordance with the present invention.
Figure 10B:
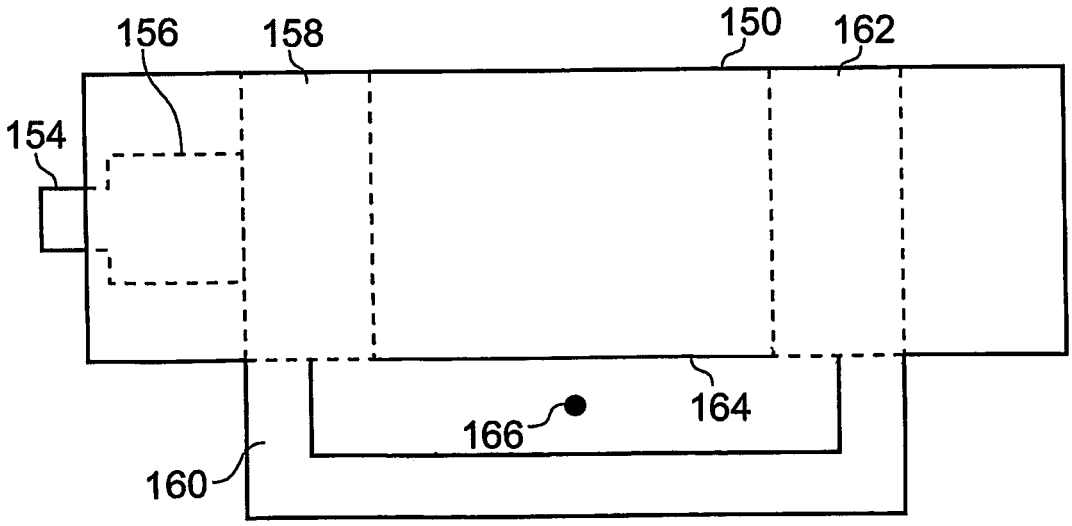

FIG. 10 therefore shows a further alternative antenna structure in accordance with the invention. Specifically, FIG. 10*a* is a side view and FIG. 10*b* is a plan view.

The antenna structure shown in FIGS. 10*a* and 10*b* is somewhat similar to that shown in FIGS. 2*a* and 2*b*. Specifically, a dielectric resonator antenna 150 is mounted on a substrate 152. The electrical signal is supplied along an input copper microstrip line 154, which has an impedance matching section 156. The electrical signal is supplied to the dielectric material 150 through a pad 158, which is located below the dielectric material. A further microstrip line 160 leads from the pad 158 to a second pad 162, which is located below the dielectric material at the opposite end thereof. The electrical signal is therefore also applied to the dielectric resonator antenna 150 at this opposite end.

As in the previously described embodiments of the invention, the input electrical signal is fed to the two pads 158, 162 such that there is a substantial phase difference between the signals fed to the two lines. In this case, the phase difference arises as a result of the additional path length which the signals must travel along the further microstrip line 160, although an additional phase shift element may be inserted into the line 160, if desired.

Again, the phase difference is preferably close to 180°, or to an odd multiple of 180° (for example, 540°, 900°, etc). However, the phase difference should not be exactly equal to 180°, or to an odd multiple of 180°. For example, the phase difference might advantageously be in the range of 160°-200° (or 520°-560°, or 880°-920°, etc); or in the range of 150°-210° (or 510°-570°, or 870°-930°, etc); or in the range of 140°-220° (or 500°-580°, or 860°-940°, etc); or in the range of 140°-160° or 200°-220° (or 500°-520°, 560°-580°, 860°-880°, or 920°-940°, etc).

As before, the presence of the microstrip line 160, running parallel to the edge 164 of the dielectric resonator antenna 150, has an effect on the resonances excited within the dielectric material. Therefore, a tuning screw 166 is provided in the area between the dielectric resonator antenna 150 and the microstrip line 166, half way along the length of the antenna 150. The tuning screw 166 acts as a choke in the magnetic field between the dielectric resonator antenna 150 and the microstrip line 160, and adjustment of the amount by which the screw 166 protrudes from the substrate 152 into the magnetic field makes it possible to adjust the degree of coupling between the antenna 150 and the microstrip line 160. This adjustment can take place for example after manufacture, and the frequency response of the antenna system can then be trimmed to give the required properties.

The major difference between this embodiment of the invention, and the embodiment of FIG. 2, concerns the dimensions of the dielectric material 150. Specifically, the dielectric material 150 has a rectangular base, with a length: width ratio of 2:0.8, as in the case of FIG. 2. However, the height of the dielectric material 150 is increased, such that it has an approximate height:width ratio of 3:0.8 (compared with a height:width ratio of 1:0.8 for the FIG. 2 embodiment).

Further, as can clearly be seen in FIG. 10*a*, the length of the dielectric material increases progressively with increasing height. In addition, or additionally, the width of the dielectric material may increase progressively with increasing height. The exact shape can be altered as desired to give a device with the required resonant frequency, and the invention is applicable to any shape of antenna which supports the desired resonant mode at the desired resonant frequency.

In addition, while FIG. 10 shows a device in which the length increases continuously with increasing height, any form of increase in length and/or width can be used. For example, the dielectric material may be formed in a stepped shape, or may be formed by stacking cuboid shaped pieces of dielectric material above one another, in order to form a stepped shape. When the base of the dielectric material is circular rather than rectangular, the required increase in size with increasing height can be achieved by forming the dielectric material in a frustoconical shape, or by stacking discs of dielectric material above one another, in order to form a stepped approximation to a frustocone.

Unlike in the case of a dielectric horn antenna, which looks superficially similar to the antenna of FIG. 10, it is desirable that the fields within the dielectric material should be reflected at the upper surface 168 of the dielectric material 150, in order to support the required resonant modes. The dielectric material 150 therefore preferably has a relative dielectric constant $\in_r$ greater than 10, and more preferably in the range from 10-36. In the case of a dielectric horn antenna, the dielectric material preferably has a relative dielectric constant $\in_r$ no greater than 2.

The structure described above can be modified further to form a particularly advantageous dual polarized or circularly polarized antenna.

Figure 11A:
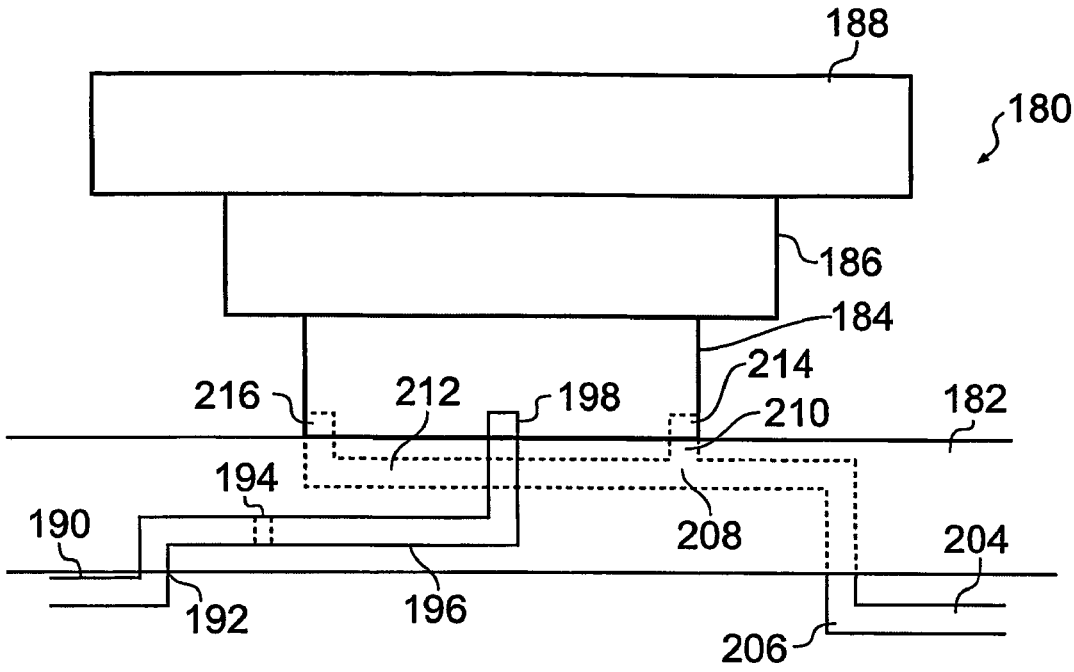
FIG. 11 is a schematic illustration of an eleventh antenna system in accordance with the present invention.
Figure 11B:
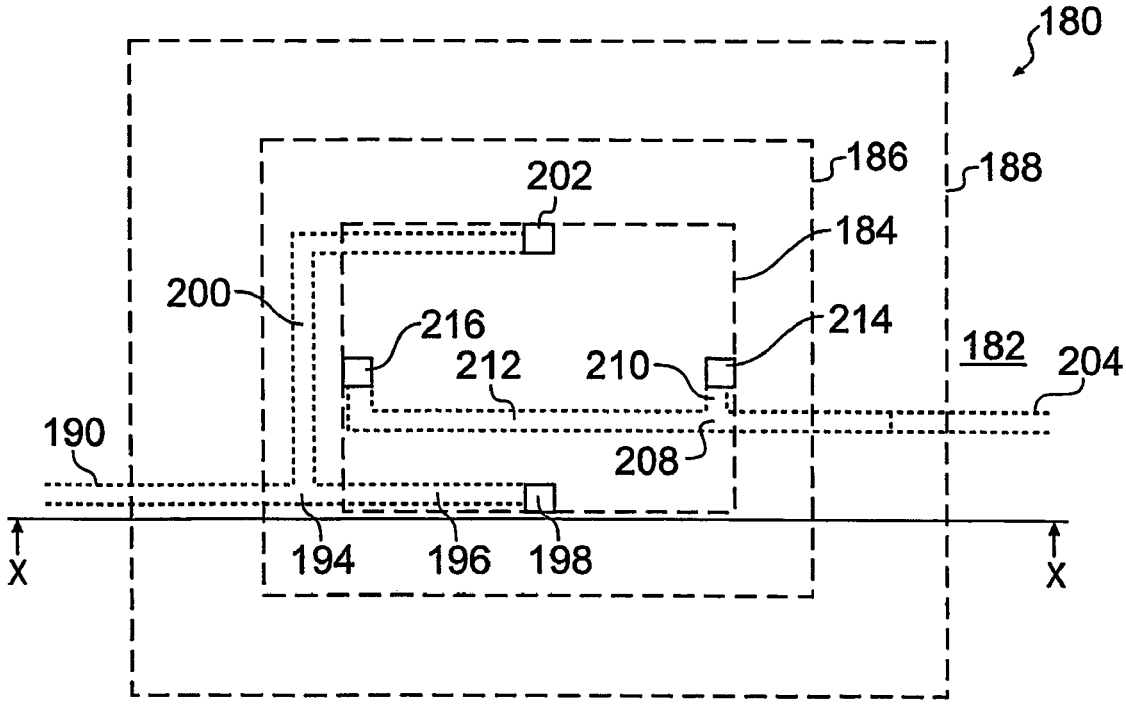

FIG. 11 therefore shows a further alternative antenna structure in accordance with the invention. Specifically, FIG. 11*a* is a side view and FIG. 11*b* is a plan view. FIG. 11*a* is a cross-sectional view formed on line X-X in FIG. 11*b*.

FIG. 11 shows a dual polarized antenna, which can be used to transmit or receive two orthogonally polarized versions of the same signal. At the receiver, these two versions can be combined, and this allows better detection of the transmitted signal, for a particular transmission power and channel quality. The antenna is described further with reference to its use as a transmit antenna, although it will be apparent to the person skilled in the art that the same structure can be used as a receive antenna.

The antenna 180 is mounted on upper surface of a multilayered substrate 182. The antenna 180 is formed from three cuboidal blocks of solid dielectric material mounted on top of one another. A first block 184, having a square cross-section when seen in plan view, is mounted directly onto the substrate 182. A second block 186, also having a square cross-section when seen in plan view, but having a larger cross-section than the first block, is mounted centrally on the first block 184. A third block 188, also having a square cross-section when seen in plan view, but having a larger cross-section than the second block, is mounted centrally on the second block 186.

A first input feed line 190 is provided initially on a lower surface of the substrate 182. From a point 192, the first input feed line 190 is etched into the substrate 182, and divides at point 194 to form a first branch 196 and a second branch 200. The first branch 196 is etched so that it feeds a first pad 198. The first pad 198 is etched into the first block 184 of dielectric material, at a point in the centre of a first side of its square cross-section. The second branch 200 is etched so that it feeds a second pad 202. The second pad 202 is etched into the first block 184 of dielectric material, at a point in the centre of a second side of its square cross-section, opposite the first side.

A second input feed line 204 is also provided initially on the lower surface of the substrate 182. From a point 206, the first input feed line 204 is etched into the substrate 182, and divides at point 208 to form a first branch 210 and a second branch 212. These branches are at a different level within the substrate from the branches 196, 200 of the first input feed line. The first branch 210 is etched so that it feeds a first pad 214. The first pad 214 is etched into the first block 184 of dielectric material, at a point in the centre of a third side of its square cross-section. The second branch 212 is etched so that it feeds a second pad 216. The second pad 216 is etched into the first block 184 of dielectric material, at a point in the centre of a fourth side of its square cross-section, opposite the third side.

A first input signal is supplied from an electronic transmitter circuit (not shown) along the first input feed line 190, and its first and second branches 196, 200, to the two pads 198, 202. A sufficient phase difference is introduced, either because of the different path lengths involved, or by means of a separate phase shift element introduced into one of the branches, that the input electrical signal arrives at the two pads 198, 202, with a phase difference close to 180°. The phase difference preferably falls within one of the ranges mentioned above in connection with other embodiments of the invention. The result is that a signal is transmitted from the antenna 180 with a first polarization.

Similarly, a second input signal, which may carry the same information content or different information content, is supplied from the electronic transmitter circuit (not shown) along the second input feed line 204, and its first and second branches 210, 212, to the two pads 214, 216. A sufficient phase difference is introduced, either because of the different path lengths involved, or by means of a separate phase shift element introduced into one of the branches, that the input electrical signal arrives at the two pads 214, 216, with a phase difference close to 180°. Again, the phase difference preferably falls within one of the ranges mentioned above in connection with other embodiments of the invention. The result is that a signal is transmitted from the antenna 180 with a second polarization, which is orthogonal to the first polarization.

The fact that the two separate input feed lines are provided allows the antenna to operate using polarization diversity. As is well known to antenna designers, circular polarization can be used if the two inputs are combined using a hybrid combiner.

There are therefore described various techniques for improving the properties of dielectric resonator antennas.

What these techniques have in common is that the input signal is fed to two points in the dielectric antenna, with a phase difference between them. In particular, the input signal is preferably fed to two points which are positioned in the dielectric antenna, in such a way that those two feed points excite two resonant modes (for example two HEM11d modes) resonating at the same frequency and propagating with a phase shift between them. The phase shift is set by controlling the phase difference between the signals applied to the two inputs. If this phase difference is not exactly 180°, then the two resonant modes couple together, resulting in a frequency separation of the two modes. In some embodiments, the two feed points are located substantially symmetrically opposite one another.

Any of the dielectric antennas shown and described herein may be used as required as part of an antenna array.

Figure 12:
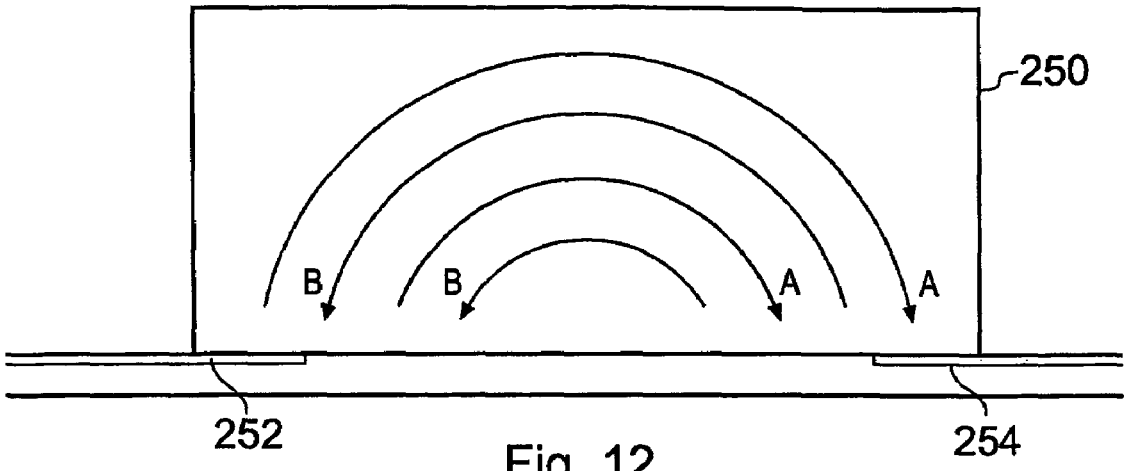
FIGS. 12 and 13 illustrate the electric fields excited in operation of an antenna system in accordance with the present invention.
Figure 13:
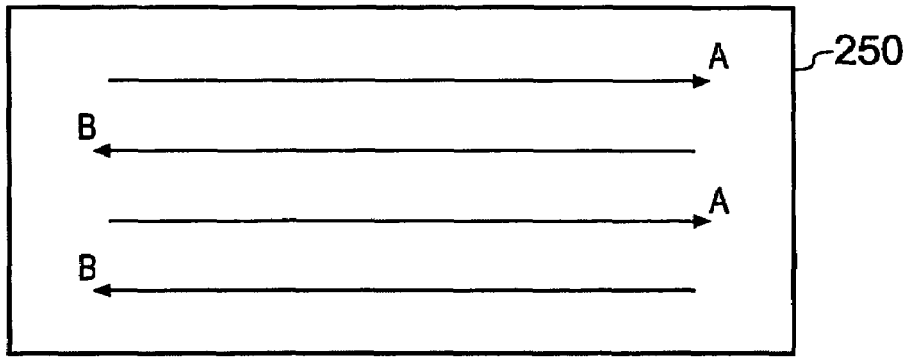

FIGS. 12 and 13 are schematic representations of the field patterns, provided for illustration of this point.

Thus, FIG. 12 is a side view of a dielectric resonator antenna 250, with feed points 252, 254 located symmetrically opposite one another at the two ends of the resonator. FIG. 13 is a plan view of the same dielectric resonator antenna 250.

As will be known to the person skilled in the art, the introduction of an electrical signal at the feed point 252 will excite a resonance within the dielectric material, if the frequency of the signal corresponds to the resonant frequency of a resonant mode of the device.

FIGS. 12 and 13 illustrate the situation where the frequency of the signal corresponds to the resonant frequency of the HEM11 resonant mode of the device. The electrical field excited by the introduction of the electrical signal at the feed point 252 can be represented by the arrows A. Thus, the field lines are generally semicircular, but lie in planes extending along the length of the dielectric material.

Similarly, the introduction of an electrical signal at the feed point 254 will excite a resonance within the dielectric material, if the frequency of the signal corresponds to the resonant frequency of a resonant mode of the device. Again, in FIGS. 12 and 13 the frequency of the signal corresponds to the resonant frequency of the HEM11 resonant mode of the device. The electrical field excited by the introduction of the electrical signal at the feed point 254 can be represented by the arrows B. Again, the field lines are generally semicircular, but lie in planes extending along the length of the dielectric material.

Thus, the two fields are parallel, or in the same planes. However, the direction of the electrical field represented by the arrows B is opposite to the direction of the electrical field represented by the arrows A.

If the electrical signals are applied to the feed points 252, 254 with a phase difference of exactly 180°, these two fields would tend to cancel each other out. However, supplying the signals to the feed points 252, 254 with a phase difference which is close to 180°, but is not exactly 180°, results in a coupling of the two fields, with a slight offsetting of their frequencies.

The amount by which the phase difference differs from 180° determines the amount by which the frequencies are offset from each other.

Figure 14:
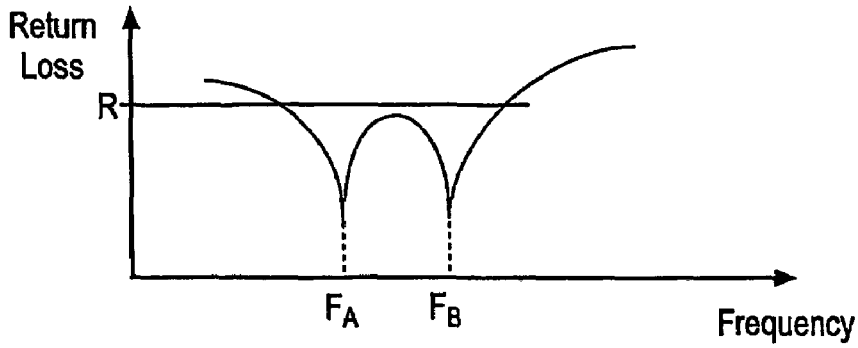
FIG. 14 illustrates the return loss characteristic of the antenna system of FIGS. 12 and 13.

FIG. 14 shows the resulting effect on the return loss characteristic of the device. Specifically, the resonant frequencies of the two fields, indicated by the arrows A and B, are offset to $F_A$ and $F_B$ respectively. The result is that the device has "double-dip" return loss characteristic, with nulls at the frequencies $F_A$ and $F_B$. By suitable choice of the phase difference between the feeds, the return loss characteristic can be forced to have an operating bandwidth (that is, the range of frequencies for which the return loss is below some threshold value R), which is considerably increased. If the phase difference is removed further from 180°, the frequencies can be offset sufficiently far apart that the device effectively has two discrete operating bands.

It will be apparent that the invention can be implemented in other ways. For example, the embodiments described herein allow coupling of an input signal to an HEM mode of the dielectric resonator. However, the input signal could be coupled to a transverse (TM) mode of the dielectric resonator in a similar way; within the scope of the invention.

The invention claimed is:

1. An antenna system, comprising a dielectric resonator and means for simultaneously supplying an electrical signal to first and second points in the dielectric resonator, with a phase difference between said first and second points, such that the first point couples to a desired mode of the dielectric resonator antenna and the second points couples to the desired mode of the dielectric resonator and such that a frequency response of the resonator has two nulls in a return loss characteristic of the frequency response, wherein the means for supplying an electrical signal comprise an electrical feed line, a first pad connected to a surface of the dielectric resonator, and a second pad connected to said surface of the dielectric resonator, and further comprising a microstrip line connecting the first and second pads.

2. An antenna system as claimed in claim 1, wherein the dielectric resonator comprises slots to allow a magnetic field generated around the electrical feed line to couple into the dielectric resonator.

3. An antenna system as claimed in claim 2, wherein the electrical feed line comprises a first path leading to a first slot in the dielectric resonator, and a second path leading to a second slot in the dielectric resonator.

4. An antenna system as claimed in claim 3, wherein the first path terminates underneath the first slot in the dielectric resonator, and the second path terminates underneath the second slot in the dielectric resonator.

5. An antenna system as claimed in claim 1, wherein the means for supplying an electrical signal comprise probes.

6. An antenna system as claimed in claim 1, comprising means for supplying the electrical signal to the first and second points with a phase difference in the range of 140°-220° therebetween.

7. An antenna system as claimed in claim 1, comprising means for supplying the electrical signal to the first and second points with a phase difference therebetween, such that a frequency response of the antenna system has two nulls in its return loss characteristic, spaced such that an operating bandwidth of the antenna system is effectively broadened.

8. An antenna system as claimed in claim 1, comprising means for supplying the electrical signal to the first and second points with a phase difference therebetween, such that a frequency response of the antenna system has two nulls in its return loss characteristic, spaced such that the antenna system operates as a dual band antenna.

9. An antenna system as claimed in claim 1, wherein the first pad is connected to the surface of the dielectric resonator at a first end region thereof.

10. An antenna system as claimed in claim 9, wherein the second pad is connected to the surface of the dielectric resonator at a second end region thereof, opposite the first end region.

11. An antenna system as claimed in claim 9, wherein the second pad is connected to the surface of the dielectric resonator system at a second region thereof, the position of the second region being chosen such that a desired HEM mode is excited.

12. An antenna system as claimed in claim 1, comprising a tuning screw located adjacent the dielectric resonator.

13. An antenna system as claimed in claim 1 further comprising at least one additional pad located underneath said surface of the dielectric resonator system to provide support therefor.

14. An antenna system as claimed in claim 1, wherein the first and second points each couple to a HEM mode of the dielectric resonator.

15. An antenna system as claimed in claim 14, wherein the first and second points in the dielectric resonator are chosen such that a higher order HEM mode is excited, and such that the antenna effectively forms a solid dielectric array.

16. An antenna system as claimed in claim 15, wherein an end face of the dielectric resonator acts as a mirror.

17. An antenna system as claimed in claim 16, wherein said end face of the dielectric resonator is coated with an electrical conductor.

18. An antenna system as claimed in claim 16, wherein said end face of the dielectric resonator is coated with a metal.

19. A method of operation of an antenna system, comprising a dielectric resonator, the method comprising simultaneously supplying an electrical signal to first and second points in the dielectric resonator, with a phase difference between said first and second points, such that the first point couples to a desired mode of the dielectric resonator and the second points couples to the desired mode of the dielectric resonator, and such that a frequency response of the antenna system has two nulls in a return loss characteristic of the frequency response; wherein supplying an electrical signal comprise supplying the signal through an electrical feed line, connecting a first pad to a surface of the dielectric resonator, and connecting a second pad to said surface of the dielectric resonator, and further connecting the first and second pads with a microstrip line.

20. A method as claimed in claim 19, comprising coupling the electrical signal to the electric field in the dielectric resonator.

21. A method as claimed in claim 19, comprising coupling the electrical signal to the magnetic field in the dielectric resonator.

22. A method as claimed in claim 19, comprising supplying the electrical signal to the first and second points with a phase difference in the range of 140°-220° therebetween.

* * * * *